US009413068B2

(12) United States Patent
Flores-Cuadras et al.

(10) Patent No.: US 9,413,068 B2
(45) Date of Patent: Aug. 9, 2016

(54) SMALL DIGITAL TUNABLE ANTENNA SYSTEMS FOR WIRELESS APPLICATIONS

(71) Applicants: Javier Ruben Flores-Cuadras, Tijuana (MX); Carlos Francisco Montoya-Mejia, Tijuana (MX)

(72) Inventors: Javier Ruben Flores-Cuadras, Tijuana (MX); Carlos Francisco Montoya-Mejia, Tijuana (MX)

(73) Assignee: TAOGLAS GROUP HOLDINGS LIMITED, Wexford (IE)

( * ) Notice: Subject to any disclaimer, the term of this patent is extended or adjusted under 35 U.S.C. 154(b) by 93 days.

(21) Appl. No.: 14/534,021

(22) Filed: Nov. 5, 2014

(65) Prior Publication Data

US 2015/0061950 A1 Mar. 5, 2015

Related U.S. Application Data

(63) Continuation-in-part of application No. 14/286,974, filed on May 23, 2014, now abandoned.

(60) Provisional application No. 61/826,493, filed on May 23, 2013.

(51) Int. Cl.

| | |
|---|---|
| ***H01Q 1/24*** | (2006.01) |
| ***H01Q 5/335*** | (2015.01) |
| ***H01Q 1/48*** | (2006.01) |

(52) U.S. Cl.
CPC ..... *H01Q 5/335* (2015.01); *H01Q 1/243* (2013.01); *H01Q 1/48* (2013.01)

(58) Field of Classification Search
CPC ..... H01Q 1/243; H01Q 1/48; H01Q 1/50; H01Q 5/335
USPC ..... 343/700 MS, 722, 745, 772, 850, 852, 343/860
See application file for complete search history.

(56) References Cited

U.S. PATENT DOCUMENTS

| | | | | |
|---|---|---|---|---|
| 3,947,850 A * | 3/1976 | Kaloi | H01Q 9/0407 | 343/795 |
| 4,063,246 A * | 12/1977 | Greiser | H01Q 21/065 | 343/700 MS |
| 4,356,492 A * | 10/1982 | Kaloi | H01Q 21/30 | 343/700 MS |
| 6,198,437 B1 * | 3/2001 | Watson | H01Q 1/38 | 343/700 MS |
| 7,196,666 B2 * | 3/2007 | Allen | H01Q 9/0407 | 343/700 MS |

* cited by examiner

*Primary Examiner* — Tho G Phan
(74) *Attorney, Agent, or Firm* — Coastal Patent Law Group, P.C.

(57) ABSTRACT

The instant disclosure provides an antenna system with a generically small ground plane and a generic antenna radiating module, wherein the system further includes a matching circuit and a tunable capacitor each bring integrated with the ground plane and antenna in a novel configuration which provides improved antenna performance across multiple antenna resonances.

11 Claims, 4 Drawing Sheets

SMALL DIGITAL TUNABLE ANTENNA SYSTEMS FOR WIRELESS APPLICATIONS

CROSS-REFERENCE TO RELATED APPLICATIONS

This application is a continuation in part (CIP) of U.S. Ser. No. 14/286,974, filed May 23, 2014;

which claims benefit of U.S. Provisional Ser. No. 61/826,493, filed May 23, 2012;

the contents of each of which are hereby incorporated by reference.

BACKGROUND OF THE INVENTION

1. Field of the Invention

This invention relates to antenna systems; and more particularly, to such antenna systems configured for with a novel frequency tuning and matching architecture.

2. Description of the Related Art

Active antennas are currently used in a wide variety of applications and are configured to performs various functions, including: (i) altering the radiation pattern; (ii) varying an electrical length of radiating elements; (iii) varying antenna impedance; (iv) shifting the antenna resonance; (v) compensating for antenna loading conditions (ex: device against the head and/or hand); (vi) increasing isolation in between antennas in MIMO systems; and (vii) decreasing the correlation coefficient within antennas, phase shifters and other complex features.

Of concern in the instant disclosure is the need to vary the antenna resonance and provide a corresponding match for a particular ground plane size and electromagnetic environment using commercially available components.

Working within newer LTE bands, including the frequencies around 700 MHz, the antenna design process is complicated due to the physical space permitted for the antenna being significantly less than the physical space needed for a conductor. Thus, the antenna is generally required to be electrically small. This results in difficulties to achieve a resonance and then the required matching to comply with the required bandwidth.

There is a significant need to develop improved antenna systems and related schemes for obtaining resonance and matching with small ground plane sizes.

SUMMARY OF THE INVENTION

The instant disclosure provides an antenna system with a generically small ground plane and a generic antenna radiating module, wherein the system further includes a matching circuit and a tunable capacitor each bring integrated with the ground plane and antenna in a novel configuration which provides improved antenna performance across multiple antenna resonances.

DETAILED DESCRIPTION

In the following description, for purpose of illustration and not limitation, detailed descriptions are provided for enabling those having skill in the art to make and use the inventive embodiments.

Figure 1A:
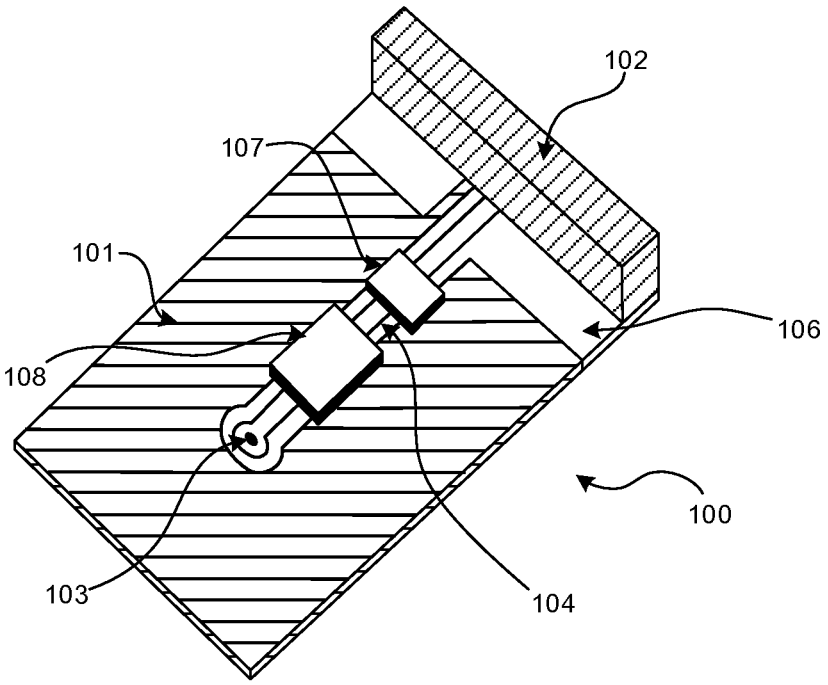
FIGS. 1 (A-C) show an antenna system with a novel configuration for achieving frequency tuning and matching across multiple antenna resonances.
Figure 1B:
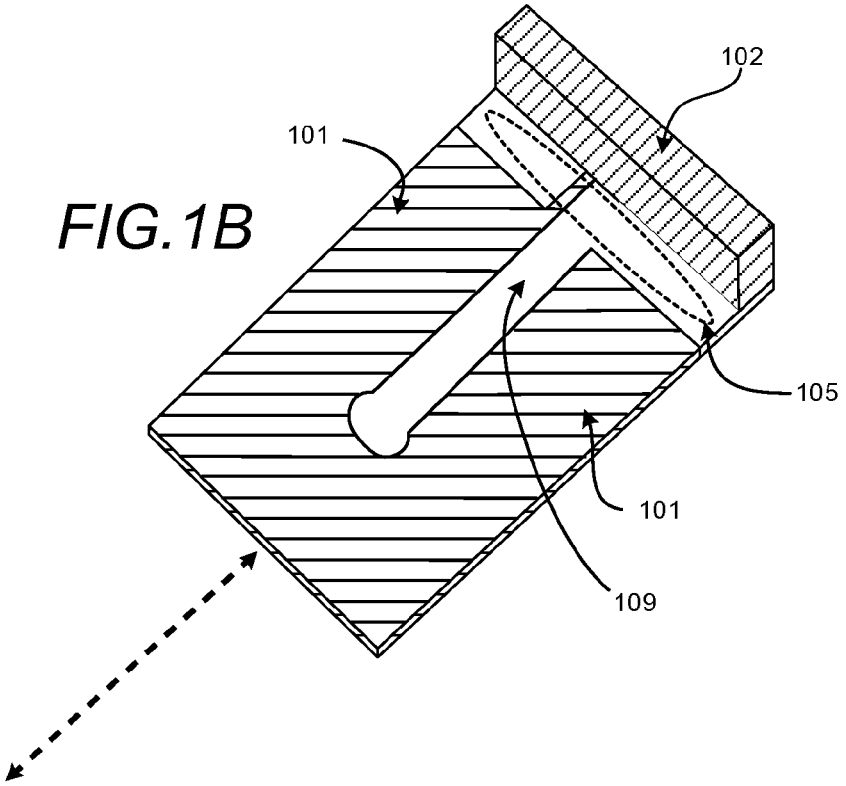
Figure 1C:
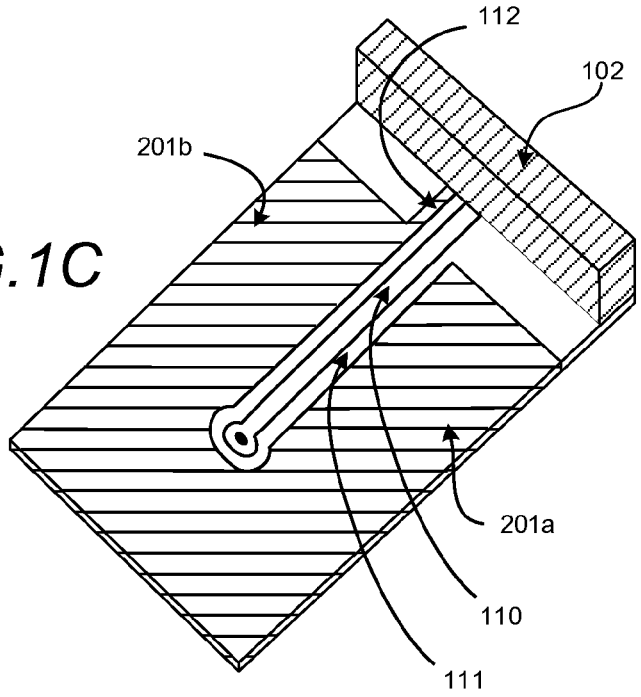

FIGS. 1 (A-C) show an antenna system with a novel configuration for achieving frequency tuning and matching across multiple antenna resonances.

The antenna system 100 comprises a substrate 106, such as a circuit board substrate, extending about a longitudinal axis L' to define a length thereof, and having a width perpendicular to the longitudinal axis. In an example, the length and width of the substrate can each be about 50 mm. The substrate 106 is further characterized wherein on a top surface of the substrate is disposed each of: a ground plane conductor 101, and an antenna module 102; the antenna module being disposed adjacent to the ground plane conductor and spaced apart therefrom to form a longitudinal gap 105 therebetween. The ground plane conductor 101 comprises a channel 109 extending inwardly from a side of the ground conductor that is adjacent to the antenna module. A feed conductor 110 extends longitudinally about the top surface of the substrate from the antenna module to a terminus of the channel, the feed conductor being isolated from the ground plane conductor via a channel gap 111 surrounding the feed conductor. A ground connection element 112 traverses the longitudinal gap from the ground plane conductor to a ground connection of the antenna module. The ground connection is not shown, the ground connection is disposed between a bottom surface of the antenna module and the top surface of the circuit board, but is widely known in the art, and typically would include a contact pad between the antenna and circuit board. The antenna module is configured to couple with the ground plane conductor via the ground connection element. A matching circuit 108 is coupled to each of said feed conductor and said ground plane conductor 101. A tunable capacitor 107 is coupled to each of said feed conductor and said ground plane conductor 101.

In an embodiment, the ground plane conductor 101 comprises a pair of longitudinal ground conductors 201*a*; 201*b*, respectively, separated by the channel 109, wherein the longitudinal ground conductors and the feed conductor collectively form a coplanar waveguide 104.

In a preferred embodiment, the tunable capacitor 107 is disposed between the matching circuit and the antenna module 102.

Figure 2:
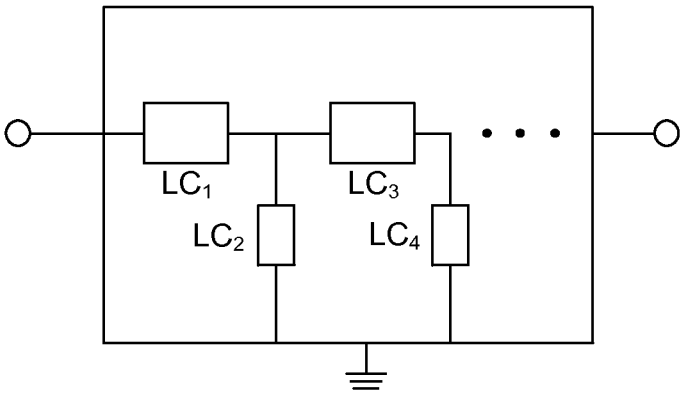
FIG. 2 shows a matching circuit for use in one or more embodiments.

As illustrated in FIG. 2, the matching circuit 108 can comprise any matching circuit configuration within the knowledge in the art. For example, in an embodiment the matching circuit can comprise one or more lumped components $LC_1$; $LC_3$ configured in series. In another embodiment, the matching circuit can comprise one or more lumped components $LC_2$; $LC_4$ configured in shunt. Any combination of series and shunt components may be similarly implemented. The lumped components may comprise resistors, capacitors, or inductors. Other components can be similarly implemented.

Figure 3:
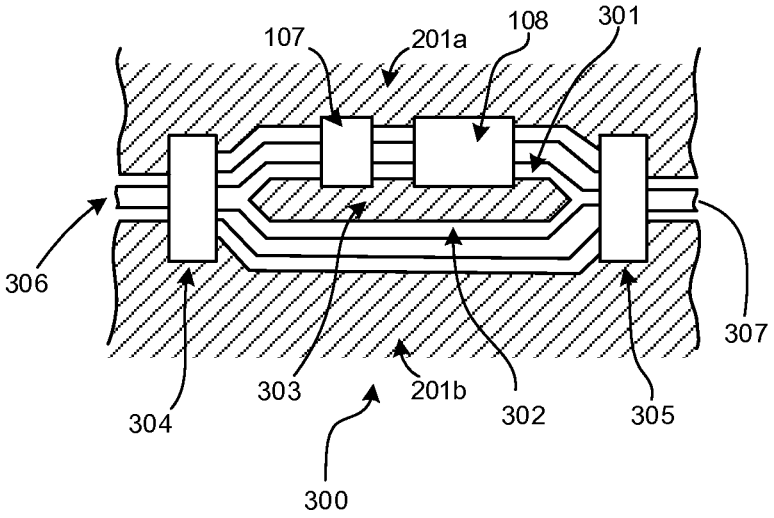
FIG. 3 shows a bifurcated transmission line configured as a switchable bypass in accordance with certain embodiments.

In another embodiment, as illustrated in FIG. 3, the antenna system further comprises a bifurcated transmission line 300.

In the bifurcated transmission line, the feed conductor 110 is configured with a first end 306 and a second end 307 each disposed arbitrarily along a longitudinal portion of the feed conductor that is captured within the channel 109. The feed conductor is bifurcated at the first end 306 to form a first feed segment 301 and a second feed segment 302. The first and second feed segments are combined at the second end 307. A longitudinal ground strip 303 is disposed longitudinally between the first and second feed segments. A first radiofrequency (RF) switch 304 is disposed at the first end of the feed conductor, and a second RF switch 305 is disposed at the second end of the feed conductor. Each of the tunable capacitor 107 and the matching circuit 108 are coupled to the first feed segment 301 between the first and second RF switches. The second feed segment is configured as a switchable bypass.

In an embodiment, a first of the longitudinal ground conductors 201*a*, the first feed segment 301, and the longitudinal ground strip 303 collectively form a first coplanar waveguide disposed between the first and second RF switches.

In another embodiment, a second of the longitudinal ground conductors 201*b*, the second feed segment 302, and the longitudinal ground strip 303 collectively form a second coplanar waveguide disposed between the first and second RF switches.

In this regard, the antenna system may be configured with a pair of coplanar waveguides disposed between the first and second RF switches along the transmission line.

Figure 4:
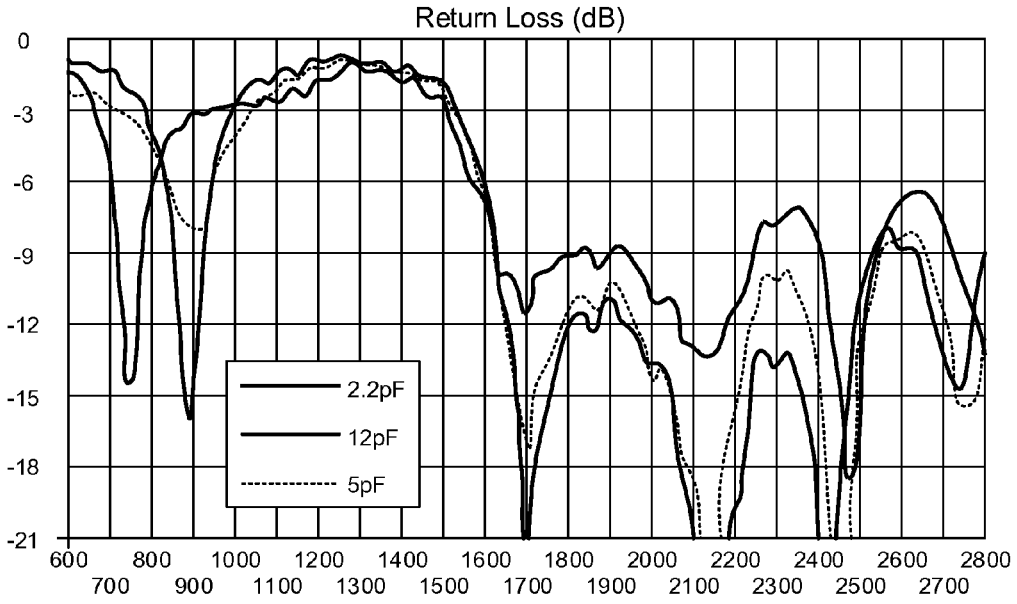
FIG. 4 shows a frequency spectrum with respect to the antenna system in accordance with an embodiment.

In preliminary experimentation, an antenna system was configured in accordance with the above descriptions using a substrate having dimensions of 50 mm×50 mm. For simplicity, the antenna described in commonly owned international PCT publication WO/WO2014058926A1, published Apr. 17, 2014, titled "LOW COST ULTRA-WIDEBAND LTE ANTENNA" was integrated with the system; the contents of which are hereby incorporated by reference. The resulting spectrum as illustrated in FIG. 4 was obtained using standard testing instrumentation.

| Reference Signs List |
|---|
| longitudinal axis (L') |
| antenna system (100) |
| ground plane conductor (101) |
| antenna module (102) |
| center pin (103) |
| coplanar waveguide (104) |
| longitudinal gap (105) |
| substrate (106) |
| tunable capacitor (107) |
| matching circuit (108) |
| channel (109) |
| feed conductor (110) |
| channel gap (111) |
| ground connection element (112) |
| longitudinal ground conductors (201a; 201b) |
| Lumped components ($LC_1$-$LC_4$) |
| bifurcated transmission line (300) |
| first feed segment (301) |
| second feed segment (302) |
| longitudinal ground strip (303) |
| first radiofrequency (RF) switch (304) |
| first radiofrequency (RF) switch (305) |
| first end of feed conductor (306) |
| second end of feed conductor (307) |

What is claimed is:

1. An antenna system, comprising:

a substrate extending about a longitudinal axis to define a length thereof, and having a width, wherein on a top surface of the substrate is disposed each of:

a ground plane conductor, and an antenna module;

the antenna module being disposed adjacent to the ground plane conductor and spaced apart therefrom to form a longitudinal gap therebetween;

the ground plane conductor comprising a channel extending inwardly from a side adjacent to the antenna module;

a feed conductor extending longitudinally about the top surface of the substrate from the antenna module to a terminus of the channel, the feed conductor being isolated from the ground plane conductor via a channel gap surrounding the feed conductor;

a ground connection element traversing the longitudinal gap from the ground plane conductor to a ground connection of the antenna module, wherein antenna module is configured to couple with the ground plane conductor via the ground connection element;

a matching circuit coupled to each of said feed conductor and said ground plane conductor; and a tunable capacitor coupled to each of said feed conductor and said ground plane conductor.

2. The antenna system of claim 1, said ground plane conductor comprising a pair of longitudinal ground conductors separated by said channel, wherein said longitudinal ground conductors and said feed conductor collectively form a coplanar waveguide.

3. The antenna system of claim 1, wherein said tunable capacitor is disposed between said matching circuit and said antenna module.

4. The antenna system of claim 1, wherein said matching circuit comprises one or more lumped components in series.

5. The antenna system of claim 1, wherein said matching circuit comprises one or more lumped components in shunt.

6. The antenna system of claim 1, comprising a bifurcated transmission line, said bifurcated transmission line comprising:

with said feed conductor having a first end and a second end each disposed about a longitudinal section of the feed conductor captured within the channel, the feed conductor being bifurcated at the first end to form a first feed segment and a second feed segment, and said first and second feed segments being combined at the second end;

a longitudinal ground strip disposed longitudinally between said first and second feed segments;

a first radiofrequency (RF) switch disposed at the first end of the feed conductor, a second RF switch disposed at the second end of the feed conductor, wherein each of the tunable capacitor and the matching circuit are coupled to the first feed segment between the first and second RF switches;

wherein said second feed segment is configured as a switchable bypass.

7. The antenna system of claim 6, wherein a first of said longitudinal ground conductors, said first feed segment, and said longitudinal ground strip collectively form a first coplanar waveguide disposed between said first and second RF switches.

8. The antenna system of claim 7, wherein a second of said longitudinal ground conductors, said second feed segment, and said longitudinal ground strip collectively form a second coplanar waveguide disposed between said first and second RF switches.

9. The antenna system of claim 6 comprising a pair of coplanar waveguides disposed between said first and second RF switches.

10. The antenna system of claim 1, wherein said tunable capacitor comprises a digital tunable capacitor.

11. The antenna system of claim 1, wherein said antenna module comprises a three-dimensional rectangular substrate with one or more conductor elements disposed on at least one side thereof.

* * * * *